US007199297B2

(12) United States Patent
Anderson

(10) Patent No.: US 7,199,297 B2
(45) Date of Patent: Apr. 3, 2007

(54) CYMBAL SYSTEM AND METHOD OF MAKING

(76) Inventor: James M. Anderson, 3371 Shining Star La., Corona, CA (US) 92881

( * ) Notice: Subject to any disclaimer, the term of this patent is extended or adjusted under 35 U.S.C. 154(b) by 191 days.

(21) Appl. No.: 10/940,178

(22) Filed: Sep. 14, 2004

(65) Prior Publication Data

US 2005/0155483 A1 Jul. 21, 2005

Related U.S. Application Data

(60) Provisional application No. 60/537,654, filed on Jan. 20, 2004.

(51) Int. Cl.
*G10D 13/02* (2006.01)

(52) U.S. Cl. ..... 84/422.3

(58) Field of Classification Search ..... 84/422.1, 84/422.2, 422.3

See application file for complete search history.

(56) References Cited

U.S. PATENT DOCUMENTS

| | | | | |
|---|---|---|---|---|
| 3,185,014 | A * | 5/1965 | Ross | 84/422.3 |
| 4,114,502 | A * | 9/1978 | Zildjian | 84/402 |
| 4,248,129 | A * | 2/1981 | Zildjian | 84/422.1 |
| 4,320,687 | A * | 3/1982 | Kidwell | 84/402 |
| 4,911,056 | A * | 3/1990 | Belli et al. | 84/402 |
| 6,034,313 | A * | 3/2000 | Shelley | 84/422.3 |
| D457,287 | S | 5/2002 | Geisen | D2/608 |
| 6,617,501 | B2 | 9/2003 | Kaufmann | 84/422.3 |
| 6,828,496 | B2 * | 12/2004 | Paiste | 84/422.3 |
| 2002/0170411 | A1 | 11/2002 | Geisen | 84/402 |
| 2003/0167900 | A1 * | 9/2003 | Paiste | 84/422.3 |
| 2005/0087059 | A1 * | 4/2005 | Hsieh | 84/422.3 |
| 2006/0027072 | A1 * | 2/2006 | Morelli | 84/422.3 |

* cited by examiner

*Primary Examiner*—Gary F. Paumen
(74) *Attorney, Agent, or Firm*—Klein, O'Neill & Singh LLP; James G. O'Neill

(57) ABSTRACT

An improved flat cymbal is formed from a flat sheet of stainless metal by laser cutting it into a selected form, such as a Maltese Cross having four arms with spaces between the arms. An opening is formed in each of the four arms. The cymbal will produce a distinctive sound that may be modified or tuned by changing the size of the openings or inserting jingles, rivets, sizzlers or shrapnel in the openings in the arms.

19 Claims, 2 Drawing Sheets

CYMBAL SYSTEM AND METHOD OF MAKING

CROSS-REFERENCE TO RELATED APPLICATIONS

This application claims the benefit of U.S. Provisional Application No. 60/537,654, filed Jan. 20, 2004.

BACKGROUND OF THE INVENTION

1. Field of the Invention

This invention relates generally to musical instruments, and, more particularly, to percussion instruments, such as a cymbal system, preferably made from stainless steel and having a plurality of open areas and a plurality of separate arms having openings therein. The openings in the arms may have jingles, sizzles or the like secured therein to produce varying sounds.

2. Description of Related Art

Drummers and others use one or more cymbals to make selected sounds when struck by a drumstick, or the like. The cymbals may be used alone or a number of different size and shape cymbals may be used by a drummer or other percussionist. One or more cymbals are usually mounted on stands, in any desired or known manner, so as to be easily reachable by the drummer or other user.

Cymbals are normally made from bronze or copper. Most cymbals are individually poured and cast from raw molten bronze, in molds. The castings are cooled and sorted by weight and then put through a complex sequence of heating, rolling, shaping, hammering (by hand or machine) and lathing techniques unique to each cymbal range. Less expensive cymbals may also be made from preformed bronze or copper sheets that start as disks with a uniform thickness. The sheets are then precession hammered and shaped to pummel them into a desired finished product having curved and tapered surfaces.

Additionally, some cymbals are further modified by having a titanium alloy coating applied, or by forming holes or successive elevations and indentations on the curved surface of the cymbal. For example, U.S. Pat. No. 6,617,501 to Kaufmann illustrates a cymbal system with successive elevations and indentations formed on a curved surface.

As is well known, different cymbals make different sounds. The most popular brand name cymbals from known manufactures such as Zildjian, Sabian and Paiste come in many different sizes. Additionally, the different size cymbals may have different profiles (degree of curvature), tapers (varying thickness), bells (cup size), ride areas (center portion), crash areas (outer edge) and weight to produce the different sounds required by different percussionists for different uses. In addition, the hammering and lathing of a cymbal produces varying patterns of indentations and grooves on the cymbals, to still further alter its sound. Because of the large cost of material and labor involved, the known cymbals from such manufacturers are extremely expensive.

It should also be noted that the inventor has developed a new system of playing drum rhythms called double tipped drumstick playing. Normal cymbals have a curved nature and do not lend themselves to double tipped drumming techniques. This is because the curved nature of their character creates attack points that over-extend the arms, wrists, and ligaments of the drummer arms.

The double tipped drumming technique is a new advanced system that is technically supported by the totally flat nature of the new cymbal system. The drumming technique involves utilizing both ends of the drumstick to achieve twice as many beats per arm motion. This double tipped drumstick technique is technically best achieved on a totally flat surface such as that of the new cymbal system proposed. Because all cymbals have a curved nature (even flat ride cymbals) it makes them difficult to play this new double tipped drumstick technique, regarding over extending ligaments and physically straining the arms, fingers and wrist.

Therefore, there exists the need in the art for a cymbal that may be manufactured in a less expensive manner using less labor, material, and time, and which provides a unique sound and/or look.

SUMMARY OF THE INVENTION

It is, therefore, a general object of the present invention to provide an improved cymbal. It is a particular object of the present invention to provide an improved cymbal formed from sheet material. It is another particular object of the present invention to provide an improved cymbal that is formed by laser cutting sheet metal. It is a further particular object of the present invention to provide an improved flat cymbal that may be formed in exotic shapes by laser cutting sheet metal. It is yet another particular object of the present invention to provide an improved cymbal that is formed using less labor, material and time by laser cutting stainless steel. And, it is another particular object of the present invention to provide an improved cymbal that is formed in unique shapes, such as a Maltese Cross, Skull Shape, Peace Symbol, Celtic Cross, Circular flat disk, long rectangular slats, Triangle, Star, etc., by laser cutting sheet metal, such as steel, stainless steel, aluminum, titanium, galvanized steel, and the like.

These and other objects and advantages of the present invention are achieved by providing a cymbal that is formed from sheet metal by laser cutting a desired shape having a plurality of openings therein. The cymbal is preferably made from flat stainless steel, and in the form of a Maltese Cross having openings in the arms of the cross. The cymbal will produce a distinctive sound that may be modified or tuned by inserting jingles, rivets, sizzlers or shrapnel in the openings in the arms, or by varying the size of the openings.

Thus, the new cymbal system, because of it's totally flat form, allows for a new innovative technique of drumming with a double tipped drumstick. The unique totally flat nature of the cymbal systems crosses, disks, slats, etc., offer innovative technical advantages that support the double tipped drumstick rhythm playing technique. This is believed to be another unique and novel technical improvement that the new cymbal systems allows drummers to incorporate into their playing style.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein like reference numerals are used throughout the several views, and, in which:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved flat cymbal and method of manufacturing various shaped flat cymbals, generally indicated at 10, in FIGS. 1–6.

Figure 1:
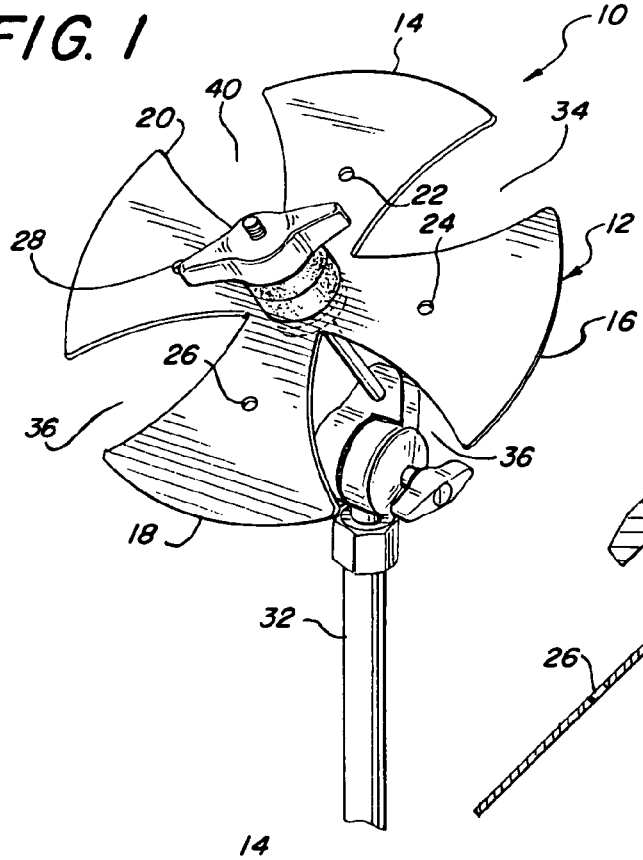
FIG. 1 is a perspective view of an improved cymbal of the present invention, mounted on a stand.
Figure 1A:
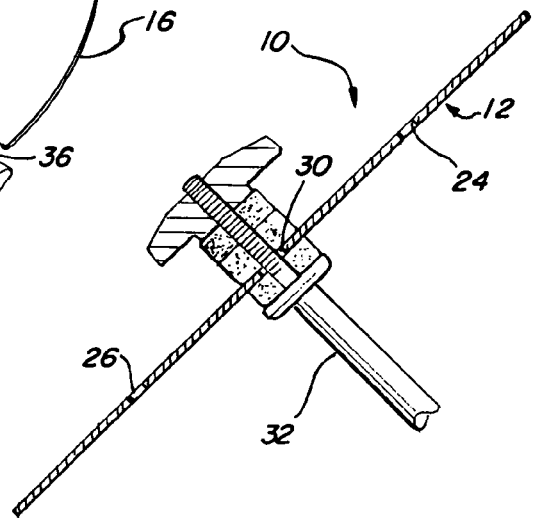
FIG. 1A is a cross-sectional view of the cymbal of FIG. 1.

Turning now to the drawings, FIGS. 1, 1A and, 2 show a currently preferred embodiment of the cymbal 10, having a body 12 in the shape of a Maltese Cross. It is to be understood that the body 12 could take any other desired flat shape that can be cut or punched out, preferably by laser cutting from a flat blank or sheet of metal, made from steel, stainless steel, aluminum, titanium, galvanized steel, or the like. The body 10 may be formed in any other desired shape that may be used as cymbal and laser cut or punched out, such as a skull, Celtic Cross, Peace Symbol, or the like.

The body 12 is preferably flat and has a flat front face and a flat rear face with four arms 14, 16, 18, 20 having openings 22, 24, 26, 28 formed therein. The openings 14–20 are formed in any desired or known manner, as by drilling, laser cutting, punching, stamping or the like. Furthermore, a central aperture 30 is formed in the body 12 to enable the body to be mounted on a stand 32, in any desired or known manner. For example, the cymbal 10 may be held between resilient washers and a wing nut and holding portion on an arm of the stand.

Figure 2:
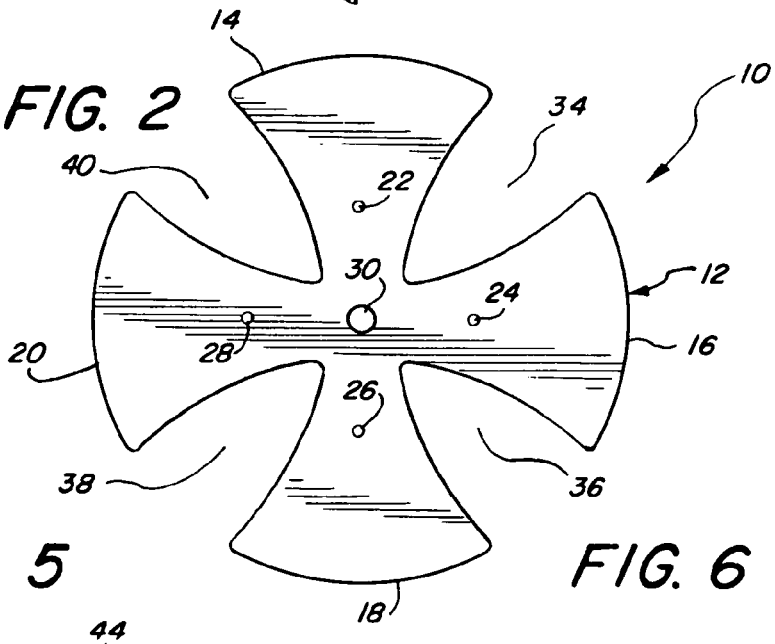
FIG. 2 is a rear elevational view of FIG. 1.

Spaces 34, 36, 38, 40 are formed between the arms 14–20 during formation of the body 12 to provide the distinct shape of the cymbal 10. The arms 14–20 and spaces 34–40 are best formed when laser cutting the body 12 from flat stainless steel using a CAD system. The openings 22–28 and central aperture 30 may be formed at the same time by the laser cutter or may be added latter, in any desired manner. After being formed, the body 12 is preferably polished with an orbital radial sander and/or vibrated with sand and rocks to remove any sharp edges and to produce a flat finished cymbal having rounded or smooth edges, as shown in FIGS. 1, 1A and 2.

As stated above, the material used to form the body 12 may be steel, stainless steel, aluminum, titanium, galvanized steel, or the like. The material is preferably stainless steel about 0.030 to about 0.060 inches thick. If made from stainless steel that is between about 0.030 and 0.048 inches thick, one or more of the arms 14–20 of the body 12, which are preferably flat, may be selectively bent by a user, to tune (vary) the sound of the arms when struck.

Figure 5:
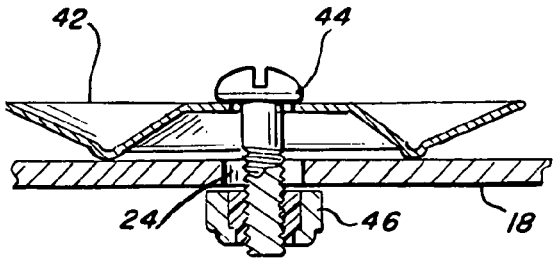
FIG. 5 is a cross-sectional view taken along line 5—5 of FIG. 3.
Figure 6:
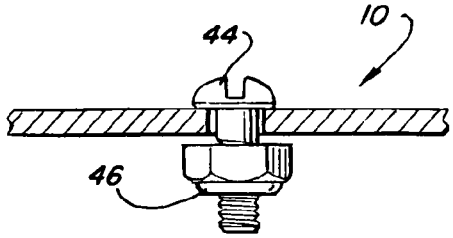
FIG. 6 is a cross-sectional view of a cymbal of the present invention having a nut and a nylon bolt mounted in an arm opening.
Figure 3:
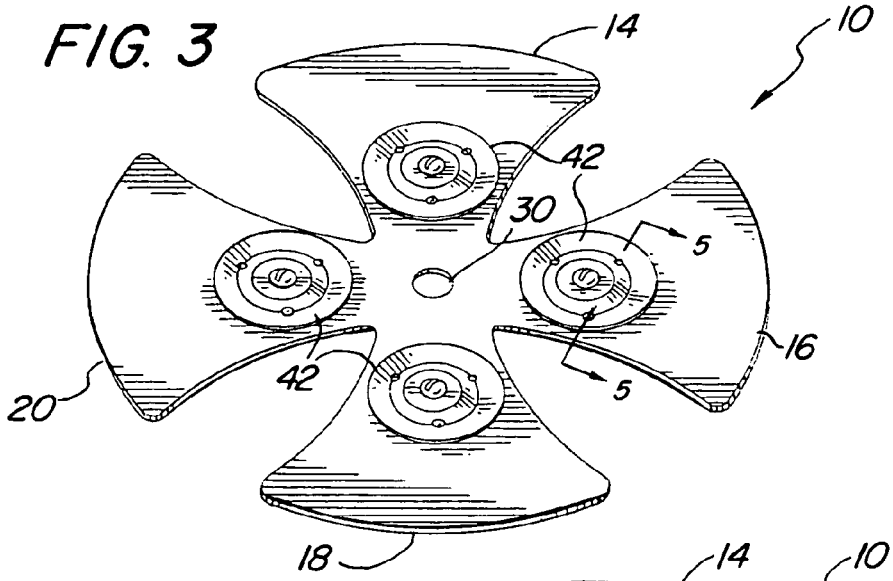
FIG. 3 is a further perspective view, looking from the top of an improved cymbal of the present invention, having jingles mounted in openings on arms thereof.
Figure 4:
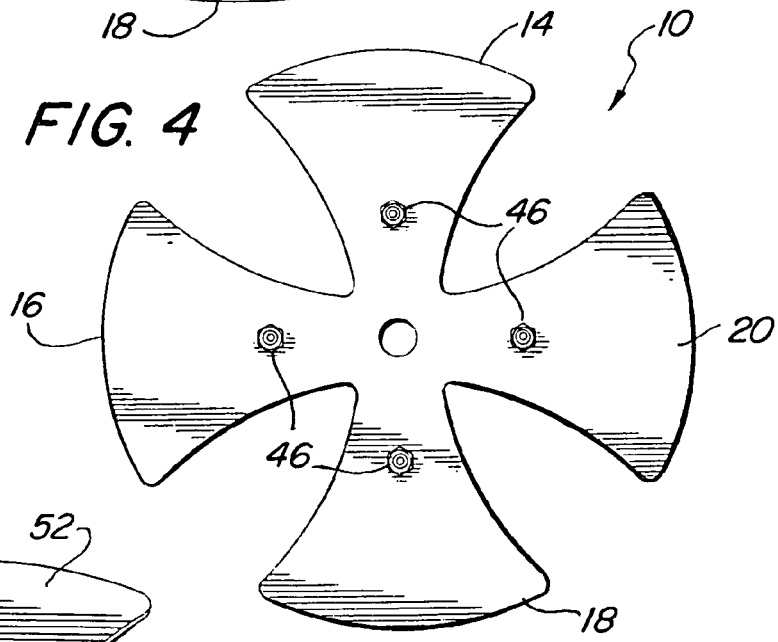
FIG. 4 is a rear elevational view of FIG. 3.

To further vary the distinctive sound of the flat stainless steel cymbal 10, tambourine-type jingles 42 may be added to or secured in the openings 22–28 in each arm 14–20, by means of bolts 44 and nylon nuts 46 (see FIGS. 3–5). Or, as shown in FIG. 6, only bolts 44 and nuts 46 may be added to the openings 22–28 in the arms 14–20. It is to be understood that other devices, such as rivets, sizzles or shrapnel could replace the bolts and nuts or jingles in the openings.

Figure 7:
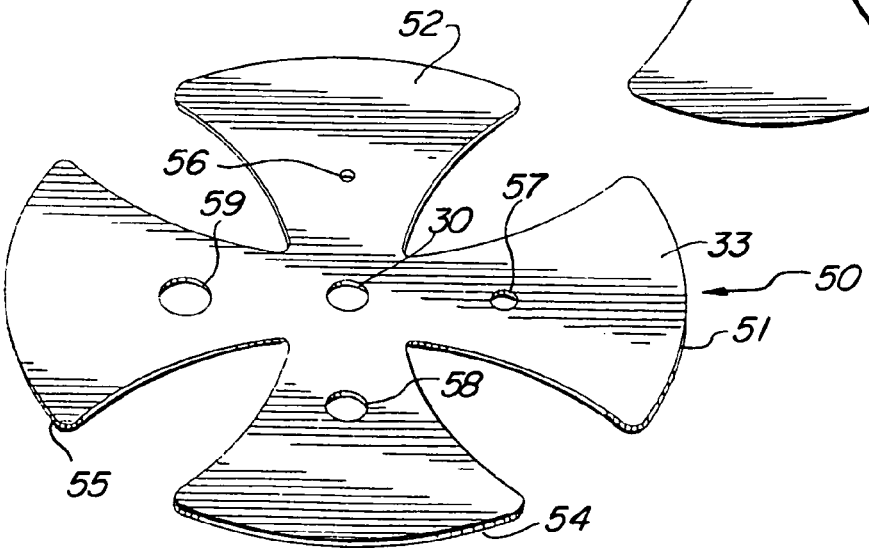
FIG. 7 is a perspective view of a further embodiment of the improved cymbal of the present invention, having different size openings formed in the four arms of the cymbal to provide differently tuned arms.

Referring now to FIG. 7, a further embodiment of a cymbal 50 of the present invention is shown. The cymbal 50 has a body 51 with four arms 52, 53, 54, 55. The arms 52–55 also preferably have spaces therebetween, similar to or substantially identical to the spaces 34–40 of the cymbal 10, and a central aperture 30 for mounting the cymbal 50 on a stand. Each of the arms 52–55 preferably have different size openings 56, 57, 58, 59 formed therein. The openings 56–59 vary in size, for example from a smaller or smallest opening 56 to progressively larger openings 57, 58, 59. The size and shape of the openings 56–59 could, of course, be varied in any desired manner to produce a different tone from each arm. In this manner, a tunable cymbal is easily produced for varying needs and/or uses.

A preferred method of forming the cymbal 10 or 50 of the present invention will now be described. A blank or continuous sheet of material, such as stainless steel, is laser-cut to a body 12 or 51, having the desired size and shape, such as the Maltese Cross shown in the drawings. The body 12 or 51 may have any desired diameter, such as 6", 8', 10", 12", 15", etc. currently used by percussionists. The openings in the arms and the central aperture are laser-cut, drilled, punched, stamped out or otherwise formed in the body at the same time, or latter. This laser-cut body is preferably of uniform thickness and flat, and is then finished by polishing or sanding to remove any flat edges to produce a cymbal having a distinctive shape and sound.

In use, one or more cymbals 10 or 50 are mounted alone or with other spaced cymbals on a stand or stands, usually adjacent a drum set and struck by a drummer using a stick or other instrument to make the desired sounds.

It, therefore, can be seen that distinctive and unique cymbals of the present invention is easily formed by laser-cutting, punching or stamping a blank or sheet of material to produce a flat, specifically shaped, stainless steel cymbal having a number of arms with openings formed therein. The cymbal is tuned by varying the thickness and diameter, as well as varying the size of the holes in the arms. Additionally, the cymbal may be caused to issue further sounds by adding securing devices in an opening in each of the arms.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A cymbal, comprising:

a flat sheet metal body having a front surface, a rear surface, a central mounting aperture and a plurality of arms having spaces formed therebetween; and a plurality of openings formed in the plurality of arms.

2. The cymbal of claim 1, further including jingles held in the plurality of openings.

3. The cymbal of claim 2 wherein there are four arms and four openings and the jingles are held in the four openings by bolts and nuts.

4. The cymbal of claim 1, further including a device held in the plurality of openings.

5. The cymbal of claim 4 wherein there are four arms and four openings and the device is loosely held in the four openings.

6. The cymbal of claim 1 wherein the body is made from stainless steel between 0.030 and 0.060 inches thick in the form of a Maltese Cross with four arms having a single opening formed in each of the four arms.

7. The cymbal of claim 6 wherein the single opening in each arm is of a different size.

8. A cymbal, comprising:

a flat stainless steel body in the form of a Maltese Cross having a flat front surface, a flat rear surface, a central mounting aperture and four arms having spaces formed therebetween; and a single opening formed in each of the four arms.

9. The cymbal of claim 8, further including a jingle secured by a bolt and a nut in each single opening.

10. The cymbal of claim 8, further including a device loosely secured in each single opening.

11. The cymbal of claim 8 wherein the flat stainless steel body is between 0.030 and 0.060 inches thick.

12. The cymbal of claim 11 wherein each single opening is of a different size.

13. The cymbal of claim 8 wherein each single opening is of a different size.

14. A cymbal, comprising:

a flat metal body having a front surface, a rear surface and a central mounting aperture;

a plurality of openings formed in the flat metal body and extending between the front surface and the rear surface; and jingles held in the plurality of openings.

15. The cymbal of claim 14 wherein the flat metal body has a plurality of arms and the plurality of openings are formed in the arms with the jingles held in the plurality of openings by bolts and nuts.

16. A cymbal, comprising:

a flat metal body having a front surface a rear surface and a central mounting aperture;

a plurality of openings formed in the flat metal body and extending between the front surface and the rear surface; and devices held in the plurality of openings.

17. The cymbal of claim 16 wherein the flat metal body has a plurality of arms and the plurality of openings are formed in the arms with the devices being loosely held in each of the plurality of openings.

18. A cymbal, comprising:

a flat metal body having a front surface, a rear surface and a central mounting aperture;

a plurality of openings formed in the flat metal body and extending between the front surface and the rear surface; and wherein the flat metal body is made from stainless steel between 0.030 and 0.060 inches thick in the form of a Maltese Cross with four arms having a single opening formed in each of the four arms.

19. The cymbal of claim 18 wherein the single opening in each of the four arms is of a different size.

* * * * *